US011753692B2

(12) United States Patent
Saccoman et al.

(10) Patent No.: US 11,753,692 B2
(45) Date of Patent: Sep. 12, 2023

(54) APPARATUS FOR THE THERMAL TREATMENT OF METALLIC PRODUCTS

(71) Applicant: DANIELI & C. OFFICINE MECCANICHE S.P.A., Buttrio (IT)

(72) Inventors: Umberto Saccoman, Bovolone (IT); Zdzislaw SZablowski, San Giovanni al Natisone (IT); Riccardo Treu, Gemona del Friuli (IT)

(73) Assignee: DANIELI & C. Officine Meccaniche S.p.A., Buttrio (IT)

( * ) Notice: Subject to any disclaimer, the term of this patent is extended or adjusted under 35 U.S.C. 154(b) by 184 days.

(21) Appl. No.: 16/954,563

(22) PCT Filed: Dec. 19, 2018

(86) PCT No.: PCT/IB2018/060310
§ 371 (c)(1),
(2) Date: Jun. 17, 2020

(87) PCT Pub. No.: WO2019/123295
PCT Pub. Date: Jun. 27, 2019

(65) Prior Publication Data

US 2020/0332386 A1 Oct. 22, 2020

(30) Foreign Application Priority Data

Dec. 20, 2017 (IT) ..... 102017000147399

(51) Int. Cl.
*C21D 9/46* (2006.01)
*B05B 1/14* (2006.01)
(Continued)

(52) U.S. Cl.
CPC ..... *C21D 9/46* (2013.01); *B05B 1/14* (2013.01); *B05B 1/30* (2013.01); *C21D 1/667* (2013.01); *C21D 1/84* (2013.01)

(58) Field of Classification Search
None
See application file for complete search history.

(56) References Cited

U.S. PATENT DOCUMENTS 4,123,393 A * 10/1978 Light ..... C07D 301/14 512/17
4,723,562 A 2/1988 Wilmotte et al.
(Continued)

FOREIGN PATENT DOCUMENTS

DE 19843038 A1 3/2000
DE 102007010375 A1 7/2008
(Continued)

OTHER PUBLICATIONS

"International Application Serial No. PCT/IB2018/060310, International Search Report dated Mar. 6, 2019", (Mar. 6, 2019), 4 pgs.
(Continued)

*Primary Examiner* — Scott R Kastler
(74) *Attorney, Agent, or Firm* — Schwegman Lundberg & Woessner, P.A.

(57) ABSTRACT

The invention relates to an apparatus (10) for the thermal treatment of metallic products, which comprises (a) a support and transport plane (24); (b) at least one collector module (12) comprising at least one collector (14, 16), the collector (14) being provided with a perforated plate (22) facing the support and transport plane (24); (b-2) a conduit (20) connected to said at least one collector (14), and (b-3) integrated in said conduit (20), at least one stop valve (18). The stop valve (18) is situated at a distance from the collector (14) which does not exceed 60 cm. The perforated plate (22) is provided with holes which are arranged in rows parallel to each other but not in parallel rows with respect to
(Continued)

the sides of said perforated plate. The rows are inclined with respect to two opposite sides of the plate (22) of an acute angle.

11 Claims, 2 Drawing Sheets

(51) Int. Cl.

| | |
|---|---|
| ***B05B 1/30*** | (2006.01) |
| ***C21D 1/667*** | (2006.01) |
| ***C21D 1/84*** | (2006.01) |

(56) References Cited

U.S. PATENT DOCUMENTS

| | | | | |
|---|---|---|---|---|
| 2005/0167897 | A1* | 8/2005 | Cramer | B21B 45/0233 266/115 |
| 2020/0332386 | A1* | 10/2020 | Saccoman | B05B 1/30 |

FOREIGN PATENT DOCUMENTS

| | | | |
|---|---|---|---|
| EP | 1938911 | A1 | 7/2008 |
| EP | 2892664 | B1 | 9/2016 |
| JP | S62166019 | A | 7/1987 |
| JP | 2003320409 | A | 11/2003 |
| JP | 2008212943 | A | 9/2008 |
| JP | 2009226478 | A | 10/2009 |
| RU | 2570712 | C1 | 12/2015 |
| SU | 1425220 | A1 | 9/1988 |
| WO | WO-03084686 | A1 | 10/2003 |

OTHER PUBLICATIONS

"International Application Serial No. PCT/IB2018/060310, Written Opinion dated Mar. 6, 2019", (Mar. 6, 2019), 6 pgs.

"Opposition against EP 3727713B1 with affidavit", w/English Translation, 63 pgs.

Schmidt, Dirk, et al., "Latest technologies in plate cooling and their benefit in plate production", SMS DEMAG, (Dec. 2007), 15 pgs.

"European Application No. 18836899.7 Reply to Opposition dated Aug. 22, 2022", 15 pgs.

"European Application Serial No. 18836899.7 Summons to attend Oral Proceedings pursuant to Rule 115(1) EPC dated Dec. 23, 2022", 11 pgs. In.

* cited by examiner

APPARATUS FOR THE THERMAL TREATMENT OF METALLIC PRODUCTS

PRIORITY APPLICATIONS

This application is a U.S. National Stage Filing under 35 U.S.C. 371 from International Application No. PCT/IB2018/060310, filed on Dec. 19, 2018, and published as WO2019/123295 on Jun. 27, 2019, which claims the benefit of priority to Italian Application No. 102017000147399, filed on Dec. 20, 2017; the benefit of priority of each of which is hereby claimed herein, and which applications and publication are hereby incorporated herein by reference in their entireties.

TECHNICAL FIELD

The invention relates to an apparatus for the thermal treatment of metallic products, such as in particular sheets and thin slabs, having thicknesses less than 50 mm, suitable for cooling the product in an effective and controlled manner by a modular and flexible system. Said apparatus is able to treat moving products as well as stationary products, and in general it can constitute a thermal treatment line to be used in on-line or off-line processes.

STATE OF THE ART

In the state of the art, it is common to carry out the thermal treatment of thin sheets and slabs through direct cooling carried out by jets of water hitting the product in a substantially perpendicular or inclined manner.

Such cooling systems are generally composed of side-by-side modular units which define the thermal treatment line.

The first generation cooling systems, although effective in cooling the products, were not particularly efficient due to the high water consumption and to the non-optimal distribution of the water on the product. This, in some cases, led to a lack of control ability, with the risk of creating unevenness along the product and thus obtaining discontinuous mechanical properties different from those of the target.

A second generation of thermal treatment modules introduced the use of sprays that spray atomised water jets directed towards the surface of the product. However, even these devices have some drawbacks, in fact they are characterized by having a complex structure comprising several collectors arranged parallel to each other and which are difficult to build and maintain, in particular for very large products. Furthermore, there is a very high consumption of compressed air for the atomisation and it is quite complicated to keep the air and water flow rates even during the treatments.

Another solution which has given good results is disclosed for example in the U.S. Pat. No. 4,723,562, and provides for the use of collectors, provided with perforated plates allowing a relatively even distribution of the water on the product to be treated.

This configuration makes it possible to thermally treat the product without an excessive flow rate of water and, at the same time, it allows a better distribution of water on the lower and upper surfaces of the product, however also this distribution does not yet cover the treated surface in an optimal manner and can leave areas of the surface not being covered by the water.

Further disadvantages can be mentioned, in particular as to the mechanical assembly, which does not allow easy maintenance.

Finally, the filling of the collectors does not take place in an optimal manner, since the filling time of the collectors with the refrigerating fluid is excessive and, moreover, there are transient phenomena, which delay the stabilization of the water flow rate around the nominal value. Furthermore, even the emptying of the upper collector, once the thermal treatment is finished, is not facilitated, producing an increase in the duration of the entire operation, even for several minutes, which hardly complies with the plant requirements.

Other apparatus for thermal treatment of metallic products are disclosed in documents WO 03/084686 A1, DE 198 43 038 A1 and EP 1 938 911 A1.

DISCLOSURE OF THE INVENTION

The object of the invention relates to an apparatus for thermal treatment of metallic products, such as in particular sheets and thin slabs, which overcomes said drawbacks and which is suitable to treat, in particular to cool, said products in an effective and controlled manner a modular and flexible system. A further object of the invention is to propose an apparatus which allows an even treatment of the treated product, which optimizes the filling and emptying times of the collectors and which simplifies the maintenance of the apparatus. Further objects and advantages of the invention will be apparent from the following description.

The object is achieved by an apparatus for thermal treatment of metallic products, which comprises

- (a) a support and transport plane to place and forward a product to be treated;
- (b) at least a collector module which comprises
  - (b-1) at least a collector, said collector being provided with
    - (b-1.1) a perforated plate on that side of the collector which is facing the support and transport plane;
  - (b-2) a conduit connected to said at least one collector for feeding it with a fluid, and
  - (b-3) integrated in said conduit, at least one stop valve, in particular an on-off valve, to permit or preclude the flow of said fluid into said at least one collector, wherein the apparatus is characterized in that said at least one stop valve is situated at a distance from the collector which does not exceed 60 cm, preferably does not exceed 35 cm, and still more preferably does not exceed 10 cm and that said perforated plate is provided with holes which are arranged in rows parallel to each other but not in parallel rows with respect to the sides of said perforated plate in which said rows are inclined with respect to two opposite sides of the plate of an acute angle.

Advantageously, the support plane is a flat transport device which allows the product to be transported through the apparatus. The collector modules within the apparatus may also comprise several collectors or also a plurality of pairs of collectors wherein, within a pair of collectors, one collector is located above (upper collector) and one collector below (lower collector) of the support plane.

Advantageously, said perforated plate is essentially parallel to the support plane and spaced from it to allow the insertion or transit of the product, of the sheet or of the slab.

The thermal treatment is preferably cooling.

In a preferred embodiment of the invention, a plurality of collectors can be grouped to define a thermal treatment collector module. Each module can comprise a plurality of collectors, advantageously divided into series which differ in their position of the collectors with respect to the support and transport plane and which are preferably parallel to each other within a series. In particular in the case wherein the support plane is a transport plane and wherein a plurality of the aforesaid modules follows one another along the transport plane, a thermal treatment line is obtained. This thermal treatment line may be located downstream of a metal laminating line and followed by further processing lines thereby forming a more complex metal processing plant.

The sheets and slabs are advantageously thin having thicknesses less than 50 mm.

It is also conceivable to treat other elongated metallic products with the apparatus according to the invention, such as tubes or profiled elements.

The support and transport plane could also be replaced by a stationary support plane to perform stationary treatments.

The stop valve is intended as any valve that opens or closes the flow of thermal treatment fluid from the conduit to the collector, but does not exclude the presence of other regulating valves that vary their degree of opening allowing the control of the flow of the fluid. Preferably, the stop valve is an on-off valve which is intended as a valve which allows two states, either complete closure or complete opening of the valve.

In the collector module between the collector and the support plane or between two opposite collectors, a chamber which receives the fluid for the thermal treatment is created. In the case of several collectors arranged in parallel therewith it is feasible to insert between the collectors elements, as described in the aforementioned US patent, wherein the side of the container facing the piece to be treated and the side facing the piece to be treated of the element interposed between two collectors are part of the same plane and in which the collectors and the elements are possibly in contact with each other or have a very narrow slot there between, to create an enlarged chamber to contain the fluid.

The cooling fluid is preferably but not necessarily water.

The construction and selection of the conduits that are connectable or connected to a supply source of the treatment fluid, in particular a cooling fluid, and of the supporting structures or frames to support the various components of the apparatus, of any fluid pumping/transport systems, of the support and transport plane types, etc. are part of the general knowledge of the person skilled in the art and therefore one can omit a more detailed description of them, also because they do not concern the core of the invention.

Each collector is equipped with at least one own stop valve that allows or denies the entry within the same of the fluid necessary for the thermal treatment of the product, which is preferably transiting below the collector.

Said stop valve is located at an extremely reduced distance from the corresponding collector, so that the filling time of the same, in the passage from closing to opening, is minimum. The indicated distances allow the travel time from the stop valve to the collector to be very low. An expert easily selects the dimensions of the conduits, the diameter of the opening of the stop valves, the flow rate of the fluid in such a way that the travel time of the fluid from the stop valve to the collector is advantageously less than 2 seconds. By consequently also selecting the dimensions of the collector and the number and position of stop valves connected to a collector, it is possible to further optimize the time for filling the same. With systems according to the state of the art, also due to the significant distance between supply valves and the collector, the times to fill a collector are even around 30 seconds. With the apparatus according to the invention and the reduced distance between stop valve and collector, times equal to or less than 10 seconds can be obtained. For this purpose, the stop valve can be positioned directly between the collector and the conduit acting as a fitting and as an end of the conduit or located near the collector along the conduit, but not at its end. In fact, it is essential that the time necessary to fill the space downstream of the stop valve(s) is as low as possible, so as to drastically reduce the transient phenomena that could lead to the development of non-uniformity in the product. In this way, the overall reactivity of the system is increased, thus reducing the time for getting up to speed the modules and thus allowing a more precise regulation of the thermal treatment. For example, it is often necessary to keep a portion of the head of the product warmer than the body in order to facilitate the wrapping to a winder (up or down-coiler). In this situation, a precise control of the fluid is therefore required to precisely delimit the untreated area from the treated area which depends on the reaction time of the thermal treatment system.

In a preferred variant of the invention, at least two stop valves are present for supplying a collector from the supply circuit. This allows, even in the case of on-off valves and, if present, with the possible help of a proportioning valve positioned upstream of the stop valves (as will be explained later), to manage the opening of only one or both of the stop valves (and with the choice of the flow rate to the proportioning valve) the flow rate of the fluid that actually reaches the container.

In the apparatus described in the prior art (U.S. Pat. No. 4,723,562), contrasting to the apparatus according to the invention, the filling of the collectors does not take place optimally, since it is the only valve that allows the filling of the upper container, and the only valve which regulates the feeding of the lower container, is positioned far from the respective collectors with a consequent lengthening of the times from the opening of the valves until the moment in which the outflowing fluid reaches the downstream container and the introduction of transitory phenomena, which delay the stabilization of the water flow rate around the nominal value.

In a preferred variant of the invention, said at least one collector module comprises at least two collectors which are facing each other and which are spaced one from the other such that the first collector is located in a higher position with respect to said support and transport plane and that the second collector is located in a lower position with respect to the support and transport plane.

The lower collector, which, similarly to the systems shown in the state of the art, is usually fixed, is fed separately and serves for the thermal treatment of the lower surface of the product.

The upper and lower terms refer to the position with respect to the support and transport plane, which advantageously is a roller conveyor suitable for transporting the metallic product to be treated. The person skilled in the art easily identifies other suitable transport systems. The support and transport plane is usually essentially parallel to the floor on which the apparatus is located.

In another preferred variant of the invention, said one or more collector(s) are connected with quick releases to the related conduit. If the connector is also connected to other parts of the collector module, such as a support frame or an arm of a pivoting system which will be described below, quick releases are provided in all the positions in which the collector is connected to parts of the collector module.

In a particularly preferred variant of the invention, the collector module further comprises at least one pivot mechanism which (i) rotates around an axis that is located outside the treating area of the product;

(ii) supports at least one collector being located above the support and transport plane; and (iii) is suitable to perform a movement to lift the at least one collector, the movement describing an arc of a circle.

The pivot mechanism for this purpose may comprise an upright to which an arm is fixed by means of a joint on which the collector to be lifted is directly or indirectly fixed, for example on conduits fixed on the arm. The aforementioned axis passes through the aforementioned joint. The movement around the axis can be implemented, for example, by hydraulic actuators. Naturally, other actuators that are widely known to the expert are also conceivable.

In this way, in the event of an emergency, the collectors or even parts of the structure of the collector module can be moved away in a few seconds from the material lying on the support and transport plane. The maintenance of a collector/collector module thus raised is also simplified.

In the apparatus according to the teaching of patent U.S. Pat. No. 4,723,562, given that the upper collector can be moved only vertically and for limited strokes, maintenance operations are uneasy; in fact, being able to be raised only vertically, the perforated plates are uncomfortable to be cleaned from possible obstructions.

Preferably, each collector is provided with a relief valve which, in the case of a collector supported by said pivot mechanism and therefore of a movable collector, is located in an area of the relative collector which is in a low zone, preferably the lower one, of the collector when the collector is in a position raised by the pivot mechanism. In this way, by gravity, the water contained by the collector will be reversed outside the same, also dragging any occlusion elements of the perforated plates to the outside of the collector. This effect is advantageous, because limestone occlusion can be formed through the use of water as a cooling fluid, as well as any residues and impurities which can be contained and transported by the aforesaid cooling fluid.

In a further embodiment of the invention, each collector further comprises a pneumatic valve connected or connectable through relative conduits to a compressed gas source. Such a system allows to speed up the emptying of the collector when required. The pneumatic valve can push a gas, for example air, into the collector in order to speed up the operation of emptying the fluid, especially when the collector is not raised.

A preferred embodiment of the invention provides that upstream of said one or more stop valves is provided a proportioning valve to regulate the flow rate inside the feeding circuit downstream of said proportioning valve. This circuit is made up of conduits that carry fluid to the stop valves. Such a valve is adapted to regulate the flow of water inside the conduits circuit, which is enclosed between the proportioning valve and the relative stop valve(s); therefore, unless it is fully tightened, this proportioning valve allows the complete filling of the conduits between the same and the stop valve(s) downstream of it. By opening the stop valve in such situation, fluid is immediately available to fill the collector being located behind the stop valve. Still in a preferred form, a proportioning valve supplies two stop valves for each collector. The stop valve can also be positioned upstream of several collectors and their corresponding stop valve(s). This allows, through the selective action of the stop valves, to feed only one or more collectors, or to fill a collector through one or more valves so as to regulate the flow rate of the fluid temporarily, for example to adapt the thermal treatment to the different types of products thus increasing the flexibility of the machine.

The perforated plates advantageously provide the presence of a high density of holes, preferably having dimensions ranging from 1 to 10 mm, so as to allow the fluid, for example a refrigerating fluid, to outflow from the collector with pressures, for example, lower than 4 bar.

As foreseen in the document U.S. Pat. No. 4,723,562, it is possible to provide tubes inside the collector which extend from the hole corresponding to a pipe opening towards the inside of the collector to allow the outflow of a fluid introduced into the collector only when this has exceeded the height of the tube with its level.

The perforated plates must allow to cover, with the jets passing through the several holes, the entire surface of the product lying and preferably passing below them without leaving untreated spaces, this is therefore not in a sufficient form achievable through a configuration of holes arranged in rows parallel to each other and also parallel to two opposite walls of the perforated plate, as provided by the arrangement of holes disclosed in the above mentioned document U.S. Pat. No. 4,723,562.

Preferably, the rows are inclined with respect to two opposite sides of an acute angle less than or equal to 30°. Advantageously, these two opposite sides are parallel to the advancement direction of the product if it is moving. A preferred shape of the plate is a rectangle which is located with the short sides parallel to the advancement direction of the product to be treated. In such a case, the two opposite sides are the short sides of the rectangle.

With such hole configurations it is possible to achieve the advantageous effect that at least one hole of one of said holes alignments (rows of holes), wets a section of product which will subsequently be wet again by a second hole belonging to a second hole alignment (row of holes) which is parallel to the previous one.

A collector with a perforated plate which is provided with such an arrangement of holes contributes to the purpose of realizing an apparatus for the thermal treatment of thin sheets and slabs which guarantees a controlled and effective treatment of the products.

A second aspect of the invention relates to a collector with a perforated plate on one side for collector modules for the thermal treatment of metal sheets and slabs in which said perforated plate is provided with holes which are arranged in rows parallel between each other but not in rows parallel to the sides of said perforated plate and that said rows are preferably inclined with respect to two opposite sides of said perforated plate by an acute angle, preferably less than or equal to 30°.

A final aspect of the invention concerns a use of the apparatus according to the invention which provides for the provision of an apparatus according to the invention and the thermal treatment of metallic products, in particular of an elongated shape, preferably of sheets and slabs with a thickness lower than 50 mm. The thermal treatment is preferably cooling. The use includes the passage of the product in front of the container(s) and wetting it with a fluid, preferably water, opening at least one stop valve. The use may comprise phases of operation of the various types of additional valves as illustrated above, the raising of the collector, the emptying of the same, etc.

The features described for one aspect of the invention may be transferred mutatis mutandis to any other aspect of the invention.

Each individual variant described in the dependent claims, in particular the pivoting system, the perforated plate with the particular arrangement of the holes, the presence of relief valves, pneumatic valves and proportioning valves upstream of the stop valves, can also be applied to an apparatus as defined in the preamble of the first claim and therefore regardless of the position of the stop valves with respect to the collector.

In their various combinations the aforesaid features optimize the proper operation of the apparatus and contribute to the dedicated, controlled, flexible and rapid treatment of metallic products, in particular of thin sheets and slabs.

The invention attains the intended purposes. The configuration of the apparatus according to the solution proposed by the inventors allows through the arrangement of the various modules, to be able to perform an efficient thermal treatment, especially for flat products, allowing as required to remove a part (the upper one) from the product for emergency situations or for quick cleaning of their interior. At the same time, thanks to the flexibility allowed by the presence and arrangement of the stop and proportioning valves, it is possible to carry out specific heat treatments according to the product to be treated, with a wide adjustment range and very low initial transients, supported by the regular and uniform outflow of the fluid from the perforated plate.

With the apparatus according to the invention, the inventors have solved the aforementioned drawbacks of the state of the art by developing an apparatus alternative to the known apparatus, again composed of one or more collector modules, which however allows easier maintenance, a high filling speed and above all also emptying of the collector(s), so as to achieve an efficient thermal treatment, also on-line, in particular for flat products.

Said objects and advantages will be further highlighted during the description of a preferred embodiment example of the invention given, by way of example and not of limitation.

Variants of the invention are the object of the dependent claims. The description of the preferred exemplary embodiment of the apparatus for the thermal treatment, of the collector ad of use according to the invention is given, by way of example and not of limitation, with reference to the attached drawings.

DESCRIPTION OF A PREFERRED EMBODIMENT EXAMPLE

Figure 1:
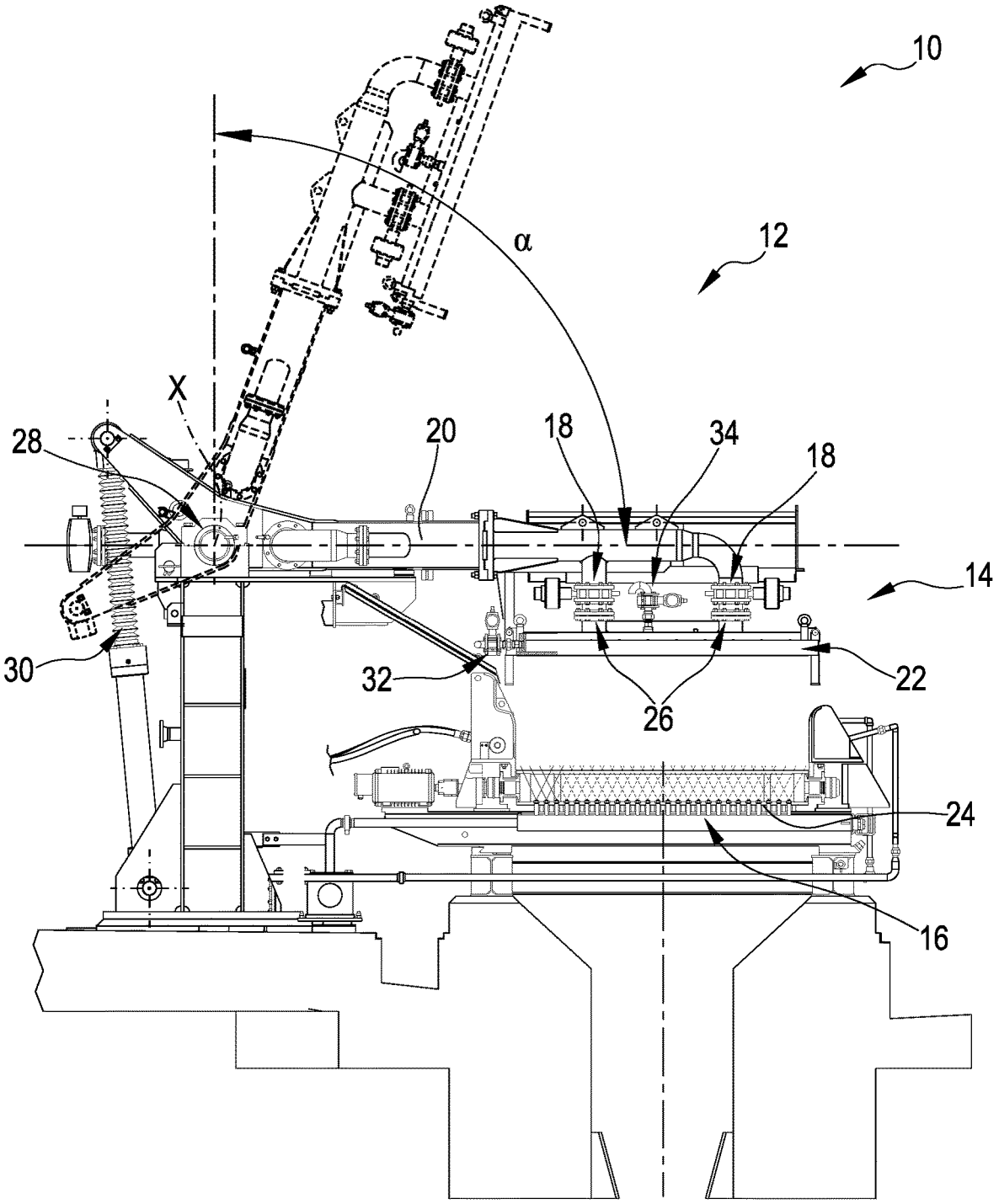
FIG. 1 shows a side view sectioned in a plane orthogonal to the advancing direction of the metallic products to be treated, an apparatus for the thermal treatment of sheets and slabs according to the invention.

FIG. 1 shows a side view sectioned in the plane orthogonal to the advancing direction of the metallic products to be treated, an apparatus 10 for the thermal treatment of metal sheets and slabs according to the invention. The figure shows only one module 12, but depending on the length of the treatment line, there may be more than one module 12.

Each module 12 comprises more collectors, in the example shown two 14 and 16. The upper collector 14 is illustrated as having two own on-off feeding valves 18, which allow or deny the entry inside the same of the refrigerating fluid necessary for the thermal treatment of the product passing under the collector 14. The fluid is transported through the conduits 20. The upper collector 14 (as well as the collector 16) is connected to a perforated plate 22 parallel and spaced with respect to the product (not shown), which forwards on the transport system 24. The plate 22 allows the cooling liquid to outflow from the collector 14 to impact on the product (not shown) for carrying out the thermal treatment. At the same time, similarly to the modules shown in the previous state of the art and as already mentioned, the apparatus 10 provides a fixed lower collector 16, separately fed always in the sense of the invention which serves for the thermal treatment of the lower surface of the product.

The on-off valves 18 are located at an extremely reduced distance from the corresponding collector 14, so that the filling time of the same, in the transition from off to on is minimum, ideally 10 seconds or less. Systems according to the state of the art currently take even 30 seconds to fill a collector.

Upstream of said valves 18, along the at least one downstream collector, there is provided a proportioning valve (not shown), adapted to regulate the flow rate of the cooling fluid, for example water, to the entire system, then unless it is fully tightened, it allows the complete filling of the conduits 20 between it and the on/off valves 18.

Each collector 14, which as said provides a perforated plate 22, is connected to the supply circuit (not shown) by two separate on-off valves 18 and is provided with quick releases 26, made for example by means of flanges, designed to allow its rapid removal from the rest of the apparatus for maintenance operations, in particular for the cleaning of the plates 22 obstructed by possible obstructions.

In the apparatus shown, each module simultaneously supplies two collectors 14, 16, and a proportioning valve (not shown) feeds through the two on-off valves 18 the upper collector 14, while a similar proportioning valve supplies the lower collector 16. This allows, through the action of the on-off valves 18, to feed even just one of the two collectors 14 forming part of the module, so as to temporarily decrease the water flow, for example for the thermal treating of certain types of products, thus increasing the flexibility of the machine.

The collectors 14 described in the present invention which, as said, are connected to the cooling fluid supply conduits 20 by means of quick releases 26, can be raised along an arc of a circle a, through a pivot mechanism 28, using for example hydraulic actuators 30, which rotates around an axis X which lies outside the flow area of the product. In such a way, in the event of an emergency, the collectors 14 can be moved away in a few seconds from the material passing along the thermal treatment line.

Each collector 14 is equipped with a relief valve 32 and preferably with a pneumatic valve 34. The relief valve 32 is disposed on the side of the collector 14 which will be located further down when the collector 14 is lifted by the pivot mechanism 28. In this way, by gravity, the water contained in the collector 14 will be reversed outside the same, dragging any occlusion elements of the perforated plates 22 to the outside of the collector 14.

At the same time, the pneumatic valve 34 can push air into the collector 14 so as to speed up the operation of emptying the refrigerating fluid even when the collector 14 is not raised.

Figure 2:
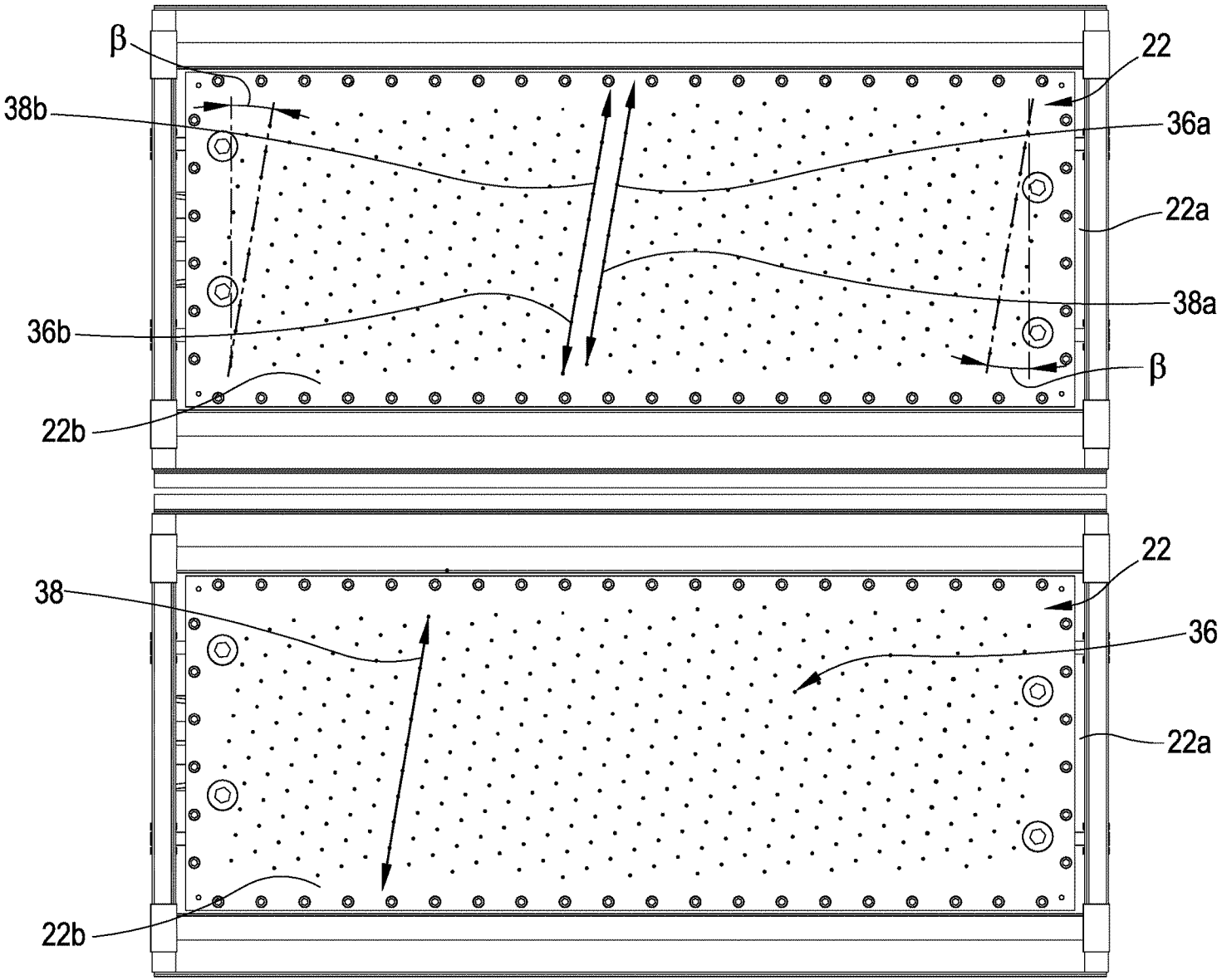
FIG. 2 shows a plan view of the succession of two parallel collectors inside the apparatus of FIG. 1 with a view of the perforated plates.

FIG. 2 shows a plan view, with the view on the perforated plates 22 the succession of two parallel collectors inside the apparatus of FIG. 1. The plates 22 provide for the presence of a high density of holes 36. The holes 36 are arranged in rows 38 parallel to each other, but not with respect to the sides 22*a* and 22*b* of the plate 22. In particular, the holes 36 are aligned in rows 38 inclined at an acute angle β of less than 30° with respect to the shorter walls 22*a* of the perforated plate 22. Thus, at least one hole 36*a* of one of the rows 38*a* wets a product section which will subsequently be wet also by a second hole 36*b* belonging to a second row 38*b* parallel to the previous row 38*a*.

During operation, further modifications or variants, not described herein, of the apparatus for the thermal treatment, of the collector and use according to the invention may be implemented. If such modifications or such variants should fall within the scope of the following claims, they should all be considered protected by the present patent.

The invention claimed is:

1. An apparatus for the thermal treatment of metallic products, comprising a support and transport plane to place and forward a product to be treated;

a collector module that comprises:

a collector including a perforated plate on a side of the collector facing the support and transport plane;

a conduit connected to the collector to feed the collector with a fluid, and at least two stop valves to feed a collector by a feeding circuit connected to the conduit and configured to permit or preclude the flow of the fluid into the collector and wherein upstream of the stop valves a proportioning valve is foreseen to regulate the flow rate inside the feeding circuit downstream of the proportional valve and wherein the proportioning valve feeds two stop valves for each collector; and wherein the stop valve is located at a distance from the collector that does not exceed 60 cm and that the perforated plate includes holes arranged in rows parallel to each other but not in parallel rows with respect to two opposite sides of the perforated plate, and wherein the rows are inclined with respect to the two opposite parallel sides of the plate at an acute angle (β).

2. The apparatus for the thermal treatment of metallic products according to claim 1, wherein the acute angle (β) is less than or equal to 30°.

3. The apparatus for the thermal treatment of metallic products according to claim 1, wherein the one collector module comprises at least two collectors which are facing each other and which are spaced one from the other such that the first collector is located in a higher position with respect to the support and transport plane and that the second collector is located in a lower position with respect to the support and transport plane.

4. The apparatus for the thermal treatment of metallic products according to claim 1, wherein the perforated plate is part of a collector which is in a higher position with respect to the support and transport plane.

5. The apparatus for the thermal treatment of metallic products according to claim 1, wherein the collector module further comprises a pivot mechanism which (i) rotates around an axis that is located outside the treating area of the product;

(ii) supports a collector being located above the support and transport plane;

(iii) is suitable to perform a movement to lift the collector, the movement describing an arc of a circle (α).

6. The apparatus for the thermal treatment of metallic products according to claim 1, wherein the collector is provided with a relief valve.

7. The apparatus for the thermal treatment of metallic products according to claim 3, wherein the upper collector further comprises a pneumatic valve connected or being connectable through respective conduits to a compressed gas source.

8. The apparatus for the thermal treatment of metallic products according to claim 1, wherein the stop value comprises an on-off valve.

9. The apparatus for the thermal treatment of metallic products according to claim 1, wherein the stop valve is situated at a distance from the collector which does not exceed 35 cm.

10. The apparatus for the thermal treatment of metallic products according to claim 1, wherein the stop valve is situated at a distance from the collector which does not exceed 10 cm.

11. The apparatus for the thermal treatment of metallic products according to claim 5, wherein a relief valve is situated in a zone of the respective collector, which is located in a low zone of the collector when the collector is in a position raised by the pivot mechanism.

* * * * *